US005232485A

United States Patent [19]

Yoshimura et al.

[11] Patent Number: 5,232,485

[45] Date of Patent: Aug. 3, 1993

[54] METHOD FOR OBTAINING HIGH PURITY TITANIUM

[75] Inventors: Yasunori Yoshimura, Asia; Yasuhide Inoha, Amagasaki, both of Japan

[73] Assignee: Sumitomo Sitix Co., Ltd., Hyogo, Japan

[21] Appl. No.: 828,198

[22] Filed: Jan. 30, 1992

[30] Foreign Application Priority Data

Jan. 30, 1991 [JP] Japan ..... 3-031918

[51] Int. Cl.[5] ..... C22B 4/00

[52] U.S. Cl. ..... 75/10.28

[58] Field of Search ..... 75/10.28

[56] References Cited

U.S. PATENT DOCUMENTS 5,108,490 4/1992 Yoshimura ..... 75/10.28

*Primary Examiner*—Peter D. Rosenberg

*Attorney, Agent, or Firm*—Oblon, Spivak, McClelland, Maier & Neustadt

[57] ABSTRACT

A method for obtaining high purity titanium by thermal decomposition of titanium iodides is provided which enhances productivity and improves the temperature control of the deposition substrate used, wherein crude titanium is charged into a reactor and a titanium tube is inserted therein. The titanium tube is indirectly heated by a heater while the interior of the titanium tube is evacuated independent of the inside of the reactor. Subsequent feeding of titanium tetraiodide into the reactor, while heating the tube from the inner or outer surface provides high purity titanium deposited on the other surface of the titanium tube.

12 Claims, 3 Drawing Sheets

METHOD FOR OBTAINING HIGH PURITY TITANIUM

BACKGROUND OF THE INVENTION

1. Field of the Invention

The present invention relates to a method for obtaining high purity titanium.

2. Discussion of the Background

Due to the rapid increase in the degree of large-scale integration (LSI) in recent years, electrode materials are undergoing a transition to those materials with higher purity and strength. For example, due to the present demand for a remedy to the signal delay caused by thinner electrode wiring, the focus is now being placed on metal materials with lower resistance, higher purity, and higher melting point, compared to the frequently used polysilicon. Metal materials with the above properties which are usable as electrodes in LSI include molybdenum, tungsten, titanium and their silicides. Among these, titanium is particularly promising, because of its excellent specific strength, workability and corrosion resistance.

In order to be used as electrode material in semiconductors, titanium metal must be of high purity. A typical method for obtaining high purity titanium is the iodide thermal decomposition process (also known as the iodine process). A conventional iodide thermal decomposition process will be described in conjunction with FIG. 3.

While a deposition substrate 23 is held at the axial center of a reactor 22 housed inside an electric furnace 21, crude titanium 24 is held inside the reactor 22, surrounding the deposition substrate 23. In this state, after evacuating the inside of the reactor 22 by use of a pump 28, iodine in an iodine container 26 is led into the reactor 22. Titanium deposition is then initiated by heating the deposition substrate 23 by passing through it an electric current from a power supply 25. Inside the reactor 22, the following reactions (1) and (2) take place.

$$\text{Crude Ti} + 2I_2 \longrightarrow TiI_4 \text{ (Synthetic reaction)} \quad (1)$$

$$TiI_4 \longrightarrow \text{High purity Ti} + 2I_2 \quad (2)$$

(Thermal decomposition reaction)

The reaction of crude titanium 24 with iodine to form $TiI_4$ proceeds on the perimeter of the reactor 22, on which the crude titanium is held at reaction temperatures of 200°–400° C. The thermal decomposition reaction of titanium tetraiodide proceeds on the deposition substrate 23 at the axial center of the reactor 22, depositing high purity titanium on the deposition substrate 23. The reaction temperature of the thermal decomposition reaction is 1300°–1500° C. The iodine produced by the thermal decomposition of titanium tetraiodide diffuses to the perimeter of the reactor 22, to be recycled for reaction with crude titanium 24.

As the deposition substrate 23, a high purity titanium filament with a diameter of 0.1–2 mm is normally used, but some attempts have been made to use plate shaped deposition substrates (Published Unexamined Patent Application No. Sho 62-294175 and No. Hei 2-73925). The crude titanium 24 used is typically in the form of a Ti sponge or machining chip in its particulate agglomerate state, and is housed in a molybdenum net 27, to be held inside the reactor 22. The reactor 22 is typically made of quartz or metal and is often lined with molybdenum to prevent gas corrosion by iodine or titanium iodides at high temperatures.

Purifying titanium by the conventional iodide thermal decomposition process has the following three problems:

The first problem is decreased productivity resulting from the use of a filament as the deposition substrate. Thus when a filament with a diameter of 0.1–2 mm OD is used as the deposition substrate, the rate of deposition is slow due to the small surface area of the deposition substrate at the initial stages of the reaction, and thus the productivity of high purity Ti is low. The filament can only be heated by generating resistance to an electric current passed through the filament. Since electrical resistance undergoes change as the filament diameter increases during the reaction, ensuring overall temperature control and maintenance of a uniform temperature over the deposition area is difficult. A localized low filament temperature might cause etching or wire-disconnection, particularly where filament and electrode leads are connected. Conversely, parts which are locally heated are susceptible to wire-disconnection from fusion.

If plate shaped deposition substrates are used, the surface area of the deposition substrate is higher initially, thus overcoming the disadvantage of low productivity. However, as in the case of the filament deposition substrate, the plate shaped deposition substrate can only be heated electrically. This is primarily due to the inability to transfer heat generated by a heater to the deposition substrate when the deposition substrate is located at the axial center of the reactor. Once again the problem of maintaining adequate temperature control during electrical heating remains unresolved.

The second problem concerns the use of crude titanium as the raw material in the process. Crude titanium, in the form of sponge or machining chips, is used in its particulate agglomerate state. However, crude titanium does not hold its shape well when charged into the reactor. Therefore, it is secured using a net made of a corrosion-resistant metal, such as molybdenum. However, this net is typically weakly secured and susceptible to break-up, making it difficult to charge large quantities of Ti into the reactor, and limiting scale-up of the apparatus.

The third problem involves the reactor. Quartz or metals, such as stainless steel, inconel, and Hastelloy, have previously been used as reactor materials. Typically a molybdenum lining is applied on the inside surface of the reactor to prevent gas corrosion by iodine or titanium iodides. While molybdenum has excellent corrosion resistance, after powder-sintering it is fragile and susceptible to cracking when assembling or dismantling the reactor, thus detracting from its repetitive use.

SUMMARY OF THE INVENTION

Accordingly, one object of the present invention is to provide a method for obtaining high purity titanium which permits high productivity as well as simple temperature control of the deposition substrate with high control accuracy.

Another object of the present invention is to provide a method for obtaining high purity titanium which permits charging a large quantity of crude titanium raw material.

It is a further object of the present invention to provide a method for obtaining high purity titanium which permits repetitive use of the reactor.

DETAILED DESCRIPTION OF THE PREFERRED EMBODIMENTS

The present invention is characterized by the use of a tube as the titanium deposition substrate in a process for obtaining high purity titanium by an iodide thermal decomposition process.

The crude titanium to be used as raw material should preferably be formed by compressing particulate agglomerate titanium into compact titanium. The reactor, together with the tube, should be coated with one of Au, Pt or Ta on any surface which will be in contact with the reaction gas.

By using a tube as the deposition substrate, independent spaces are formed in- and out-side of the tube. One of the independent spaces is set as the reaction space, while a heating means for indirectly heating the tube is disposed in the other space. The indirect heating means may be placed in proximity to the tube over its entire length, but isolated from the reaction space permitting indirect heating of the deposition substrate. High purity titanium is deposited on the tube surface opposite to the heating side. By indirect heating with a heater, the tube will be heated without being affected by the rate of deposition of titanium, providing uniform temperature distribution in the tube's axial direction. By evacuating the heating space in which such an indirect heating means is disposed, contamination of deposited titanium by impurities can be completely prevented.

Since a tube permits its diameter and length to be arbitrarily selected, the deposition surface area may be drastically increased, as compared to that of a filament. The increase in tube wall thickness associated with titanium deposition is gradual, relative to the deposition time, thus permitting the iodide reaction to be run under stable reaction conditions. Further, the use of a tube deposition substrate is advantageous when compared with plate shaped deposition substrates. When a plate shaped substrate is heated, temperature irregularities occur resulting in spotty deposition, and a risk of etching. Moreover, the change in electrical resistance with advancing deposition is large, making temperature control difficult. Tubes do not involve such difficulties. Further, if the tube is made of titanium with purity nearly as high as that of the deposited titanium, after the reaction the tube may be wholly used as the product.

The compact titanium formed by compression may be readily stacked, so that a large amount may be charged to the reactor. On surfaces in contact with the reaction gas in the reactor, a coating of Au, Pt, or Ta is beneficial not only in corrosion resistance to iodine and titanium iodides at high temperatures but also in expansibility. Thus, the coating is free of cracking, unlike molybdenum coating.

Figure 1:
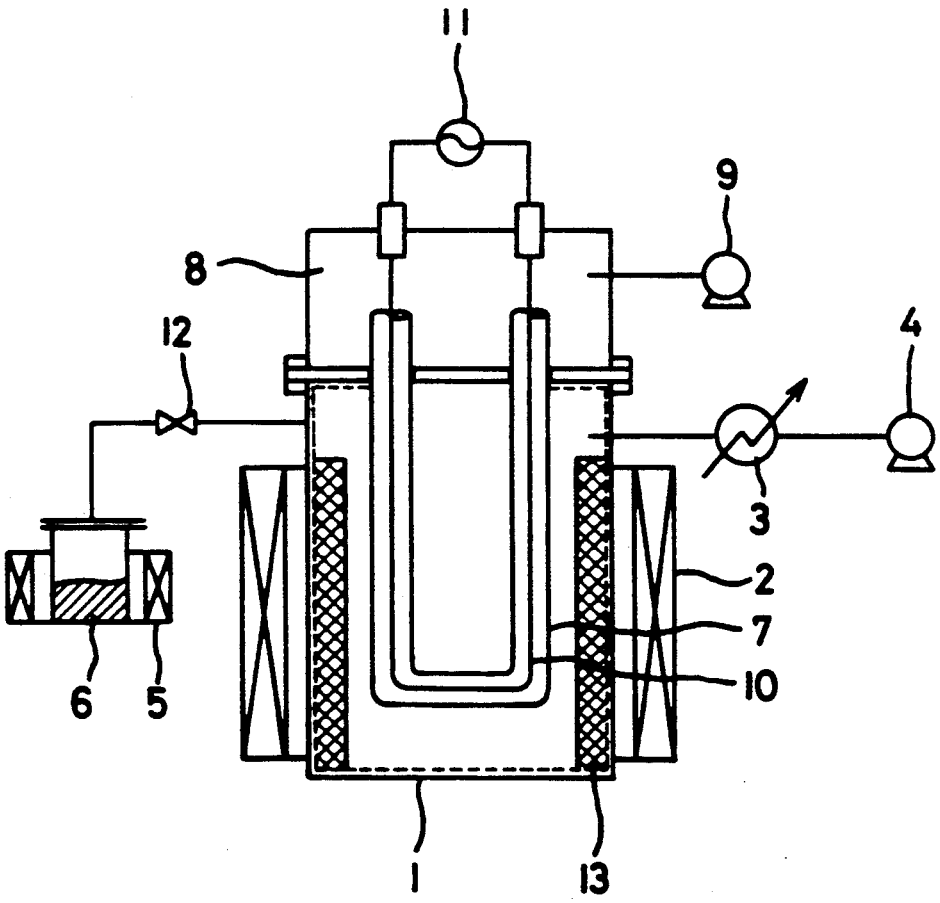
FIG. 1 is a schematic diagram showing an embodiment of this invention.

A more complete appreciation of the invention and many of the attendant advantages thereof will be readily obtained as the same becomes better understood by reference to the following detailed description when considered in connection with the accompanying drawings, wherein:

FIG. 1 is a schematic diagram showing a representative embodiment of this invention.

The reactor 1 is a cylindrical air-tight container made of stainless steel, inconel, Hastelloy, or similar corrosion resistant material and is inserted in a heating oven 2. On the inside surface of the reactor 1, Au, Pt or Ta is coated to a thickness of 2 mm or less. A vacuum pump is connected to the reactor through a trap 3, and a titanium tetraiodide container 6 housed in an electric furnace is connected through a valve 12.

A high purity titanium tube 7 is used as a deposition substrate. The titanium tube is bent to form a U-shape and inserted in the reactor 1. The interior of the reactor 1 is divided by titanium tube 7 into a reaction space outside the tube and a heating space inside the tube. The interior of titanium tube 7 is communicated to the inside of an exhaust chamber 8 coupled to the top of reactor 1. The inside of chamber 8 is evacuated by a vacuum pump 9 separately from the inside of the reactor 1. In the interior of titanium tube 7, a heater 10 such as a carbon heater, is inserted as the indirect heating means. The heater 10 is supported by chamber 8 and the temperature is controlled by external power supply 11. The heater 10 should be one that may be subjected to single- or multi-stage temperature control in its longitudinal direction. The temperature of the titanium tube may be measured indirectly or directly by use of a radiation thermometer or thermocouple.

When purifying titanium, crude titanium 13 is charged into reactor 1. As the crude titanium 13, compact titanium is used, formed by compression of spongy titanium on a press into columnar, doughnut or cylindrical shape or their multi-divided shape. An appropriate number of pieces of compact titanium are stacked along the inner circumferential surface of reactor 1. In order to ensure secure holding of the crude titanium, reinforcement may be used around the titanium. A clearance of about 20–200 mm is always maintained between the crude titanium 13 and the titanium tube 7.

According to the process of the present titanium tetraiodide, as previously developed by the present inventors (PA No. Hei 2-11089), is allowed to react with crude titanium, forming the lower valent titanium iodides $TiI_2$ and $TiI_3$, and subsequently high purity titanium is formed by thermal decomposition of the lower valent titanium iodides.

The lower valent titanium iodides require higher synthetic reaction temperatures but lower thermal decomposition reaction temperatures, compared to titanium tetraiodide. In order to effectively utilize the low reaction temperatures of lower valent titanium iodides, lower valent titanium iodides are initially prepared by reacting titanium tetraiodide with crude titanium, then, high purity titanium is obtained via these lower valent titanium iodides. Although the mechanism for the reaction of titanium with lower valent titanium iodides is not definitely known, the reactions represented by (3) and (4) are presumed to occur inside the reactor:

$$\text{Crude Ti} + TiI_4 - TiI_2 \text{ (Synthetic Reaction)} \quad (3)$$

$$TiI_2 \longrightarrow \text{High purity Ti} + TiI_4 \quad (4)$$

(Thermal decomposition reaction)

The reaction of crude titanium with titanium tetraiodide is performed at about 700°-900° C., which is higher than that used to make titanium tetraiodide, and yields low valent titanium iodides in gas form. At the lower temperatures of this reaction, titanium tetraiodide is maintained in a gaseous state, including that which has not undergone reaction and that which has been formed by thermal decomposition. Accordingly, the crude titanium surface does not become coated with lower valent titanium iodides and titanium tetraiodide. The lower valent titanium iodides more readily undergo thermal decomposition than titanium tetraiodide, permitting the thermal decomposition temperature to be lowered down to about 1,100°-1,300° C. Therefore, the thermal decomposition of metal impurities is inhibited, eliminating the possibility of metal impurities mixing into deposited titanium.

If titanium iodides (titanium tetraiodide and lower valent titanium iodides) are continuously or intermittently removed from the reactor, while continuously or intermittently feeding titanium tetraiodide into the reactor during the reaction, the metal impurities or gas impurities delivered from crude titanium into the titanium iodide gases are removed from the reactor, thus avoiding the possibility of metal or gas impurities being concentrated in the titanium iodides gases inside the reactor.

In performing the process of the present invention the inside of the reactor 1 is evacuated to $10^{-1}$-$10^{-3}$ Torr by use of a vacuum pump 4, while heating the reactor 1 to about 700°-900° C. with the heating oven 2. After indirectly heating the titanium tube 7 to 1100°-1300° C. from inside, while evacuating the interior of the titanium tube 7 to $10^{-4}$-$10^{-5}$ Torr, the evacuation of the inside of the reactor 1 is continued to maintain the inside of the reactor 1 at $10^{-3}$-$10^{-1}$ Torr, while feeding titanium tetraiodide vapor into the inside of the reactor 1 from the titanium tetraiodide container 6.

In this way, the titanium tetraiodide introduced into the reactor 1 from the bottom reacts with the crude titanium 13 held on the perimeter of the reactor 1, to form lower valent titanium iodides ($TiI_2$, $TiI_3$). The lower valent titanium iodides reach the central part of the reactor 1 by gas diffusion, depositing high purity titanium on the surface of the titanium tube 7. The iodine produced by this thermal decomposition and titanium tetraiodide again react with the crude titanium 13, to form more lower valent titanium iodides. The titanium tetraiodide and lower valent titanium iodide gases repeat these reactions as they travel up within the reactor 1. They are finally condensed and captured by a trap 3 which is cooled to lower than the condensing temperature of titanium tetraiodide, while high purity titanium is deposited on the titanium tube 7. The captured titanium iodides are a mixture of titanium tetraiodide and lower valent titanium iodides ($TiI_2$, $TiI_3$). By reaction with iodine, the lower valent titanium iodides may be transformed into titanium tetraiodide, for recycling.

A titanium tube 7 is used as the deposition substrate. Since its diameter and length of the titanium tube 7 may be arbitrarily chosen, it is possible to make the deposition surface area very large. Relative to deposition time, the thickening of the titanium tube 7 resulting from titanium deposition is slow, permitting the iodide reactions to be run under constant reaction conditions. By using a titanium tube 7 with a purity on the same order as that of the deposited titanium, the titanium tube 7 may be wholly used as the product following reaction.

The titanium tube 7 is indirectly heated by a heater 10. This permits easy temperature control of the deposition substrate and the deposition area may be readily kept uniform through multi-stage temperature control.

The interior of the titanium tube 10 is held under high vacuum independent of the inside of the reactor 1. In this way, impurities such as metals, or oxygen, which may occur from the heater 10 and the titanium vapor from the heated titanium tube 7 are rapidly exhausted to the outside, avoiding contamination of the deposited titanium. The temperature of the titanium tube 7 may be measured with high accuracy by use of a radiation thermometer or thermocouple.

Crude titanium 13 is compact titanium formed by compression. Therefore, the crude titanium is not fragile and permits easy charging of the reactor 1. The ability to change compression pressure enables adjustment of the holding strength, which allows for the ability to produce compact titanium of a variety of sizes. The ability to charge a large amount of raw material leads to the possibility of scale-up of the apparatus.

The reactor 1 is lined with Au, Pt, or Ta on its inner surface at a thickness of less than 2 mm, giving high temperature corrosion resistance. The use of Au, Pt or Ta provides expansibility, avoids cracking, and is, therefore, conducive to apparatus scale-up. Because either is highly resistant to titanium iodides and iodine, Au, Pt or Ta does not mix into the deposited titanium. The coating thickness of Au, Pt or Ta is limited to less than 2 mm because its thickness, if in excess of 2 mm, results in large distortion due to the difference in the coefficient of thermal expansion between the reactor wall and the coating thereon. This coating shall be applied at least on the inner surface part of the reactor 1 which is to be brought in contact with the reaction gases.

Figure 2:
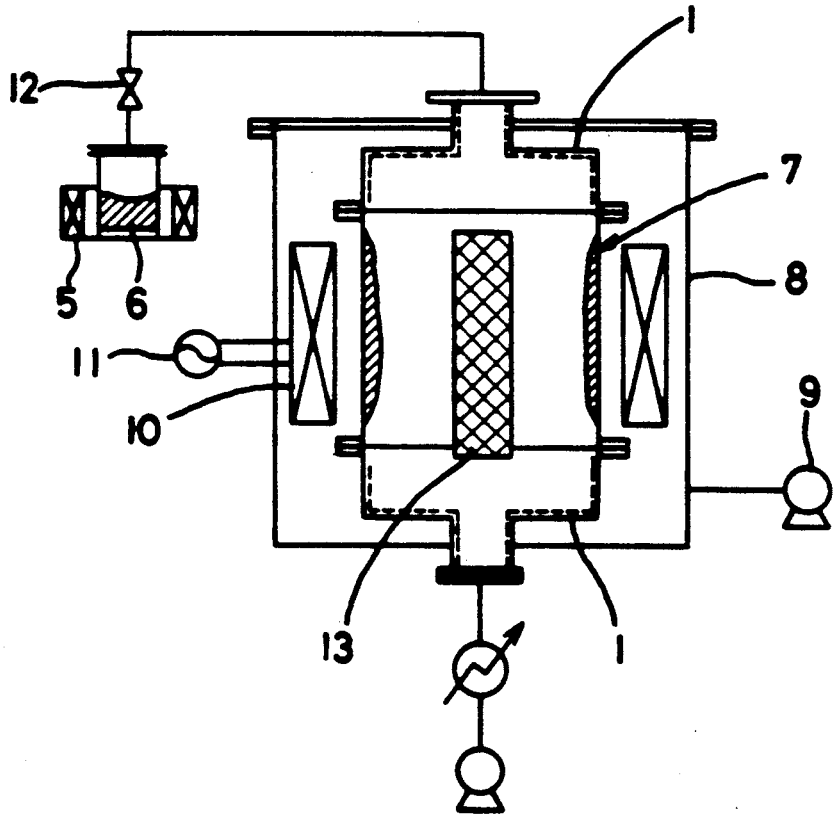
FIG. 2 is a schematic diagram showing another embodiment of this invention.
Figure 3:
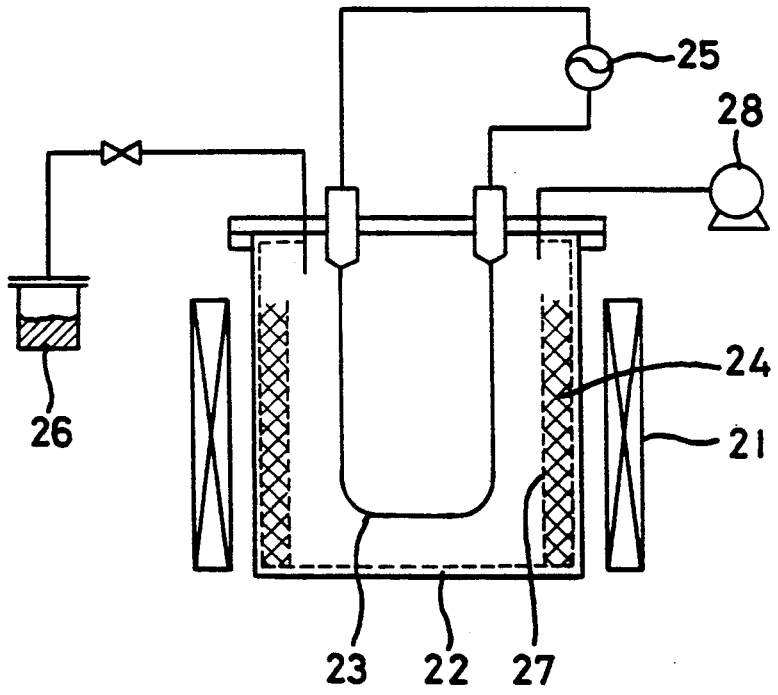
FIG. 3 is a schematic diagram showing the conventional method.

FIG. 2 is a schematic view showing another embodiment of this invention. A titanium tube 7 is held between a pair of upper and lower split reactor segments 1, 1, which form part of the reactor. Crude titanium 13 is held within the titanium tube 7 and the temperature controlled by air-cooling. A heater 10 for heating the titanium tube 7 is located outside the titanium tube 7. The heater 10 doubles as a reaction space heating means and is housed inside a chamber 8, together with the titanium tube 7. In this embodiment, high purity titanium is deposited on the inner surface of the titanium tube 7.

It should be noted that it is possible to deposit titanium on the inner or outer surface of the titanium tube by heating the titanium tube 7 by electrical resistance. Additionally, a quartz tube coated with a metal such as Ta or Mo, which does not react with titanium, may be employed in place of the titanium tube. As the tube shape, a U-shape or straight line tube shape or other shapes may be chosen, as appropriate. For the deposition reactions, the conventional reactions based on the use of iodine may be utilized.

Use of a tube as the deposition substrate according to this invention enables increased productivity, because of the large initial titanium deposition surface area. Because the change in the surface area is relatively small as the reaction proceeds, it is easy to maintain constant deposition conditions. Because this method permits indirect heating by use of a heater, temperature control is easy, holding uniform temperature is possible, and frequent wire-disconnection, which is unavoidable in the electrical resistance heating of filaments, is avoided. The heating space in which the indirect heating means is housed may be evacuated independently from the reaction space. In this way, such impurities as metals or oxygen are continually removed, avoiding contamination of the deposited titanium.

Compact titanium formed by compression has very high cohesion strength, and when used as the crude titanium, makes material charging into the container easy. Thus it may be charged in large quantities, permitting scale-up of the apparatus. Coating the reactor with Au, Pt, or Ta will avoid cracking of the coating, as seen with Mo, thus permitting repetitive use of the reactor. Further, it assures a great deal of improvement in ease of handling at the time of setting-up and dismantling of the reactor and permits scale-up of the reactor. Furthermore, because of its excellent corrosion resistance to iodine and titanium iodide gases at high temperatures, there is no degradation of the deposited titanium due to contamination.

Having generally described this invention, a further understanding can be obtained by reference to the following specific example which is provided herein for purposes of illustration only and are not intended to be limiting unless otherwise specified.

Titanium was purified by the present method, using a reactor with 400 mm ID and 800 mm height, a titanium tube with 60 mm OD, 56 mm ID and 1500 mm length and 80 kg of crude titanium, with the crude titanium being heated to 900° C., and the titanium tube to 1200° C., the amount of titanium tetraiodide being fed at 100 g/hr, and the pressure within the reactor being held at approx. 10 Torr. After 100 hr reaction time, 16 kg of high purity titanium was obtained. As a control, a similar purification was performed, with the titanium tube replaced by a filament of high purity titanium. Only 3.3 kg of high purity titanium was obtained after 100 hr.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method for obtaining a high purity titanium comprising:

heating with an indirect heating means, a crude titanium material in the presence of titanium tetraiodide in a reactor to form at least one of the lower valent titanium iodide $TiI_2$ or $TiI_3$, at a temperature sufficient to maintain said titanium tetraiodide and any of said lower valent titanium iodides in a gaseous state; and depositing a high purity titanium on a tube having an inner surface and an outer surface by heating at least one of said lower valent titanium iodides to a temperature sufficient to cause thermal decomposition of said lower valent titanium iodides.

2. A method for obtaining a high purity titanium as claimed in claim 1 wherein said tube comprises a tube made of high purity titanium.

3. A method for obtaining a high purity titanium as claimed in claim 1 wherein said tube is indirectly heated from either of said inner surface or said outer surface and a high purity titanium is deposited on the other surface.

4. A method for obtaining a high purity titanium as claimed in claim 1 wherein said crude titanium comprises a compact titanium formed by compression.

5. A method for obtaining a high purity titanium as claimed in claim 1 wherein said reactor has an inner surface which is coated with a metal selected from the group consisting of gold, platinum, and tantalum.

6. A method for obtaining a high purity titanium as claimed in claim 1 wherein said tube divides said reactor into a heating space and a reaction space.

7. A method for obtaining a high purity titanium as claimed in claim 7 wherein said heating space in which said indirect heating means is disposed is isolated from said reaction space, and each of said heating space and said reaction space may be evacuated independently from the other.

8. A method for obtaining a high purity titanium, comprising the steps of:

reacting a crude titanium material by the iodide thermal decomposition process, and depositing high purity titanium thus obtained on a tube having an inner surface and an outer surface, wherein said tube divides said reactor into a heating space and a reaction space, wherein said heating space is heated by an indirect heating means and said high purity titanium is deposited on the surface of said tube in contact with said reaction space.

9. A method for obtaining a high purity titanium as claimed in claim 8, wherein said tube comprises a tube made of high purity titanium.

10. A method for obtaining a high purity titanium as claimed in claim 8, wherein said crude titanium comprises a compact titanium formed by compression.

11. A method for obtaining a high purity titanium as claimed in claim 8, wherein said heating space in which said indirect heating means is disposed is isolated from said reaction space, and each of said heating space and said reaction space may be evacuated independently from the other.

12. A method for obtaining a high purity titanium as claimed in claim 8, wherein said tube, on which high purity titanium is deposited, is regulated in temperature in a multi-stage manner to provide a uniform temperature-distribution in a longitudinal direction of said tube.

* * * * *